United States Patent [19]

Spamer et al.

[11] 4,334,374

[45] Jun. 15, 1982

[54] MEANS FOR ATTACHING A PANEL TO AN UPRIGHT

[75] Inventors: William S. Spamer, Roswell; Robert C. Barker, Lilburn, both of Ga.

[73] Assignee: The Mead Corporation, Dayton, Ohio

[21] Appl. No.: 247,765

[22] Filed: Mar. 26, 1981

[51] Int. Cl.[3] ..... G09F 15/00

[52] U.S. Cl. ..... 40/606; 52/239; 52/772; 40/617

[58] Field of Search ..... 40/10, 605, 606, 607, 40/617; 52/239, 772

[56] References Cited

U.S. PATENT DOCUMENTS

| | | | |
|---|---|---|---|
| 2,345,913 | 4/1944 | Bishop | 40/606 |
| 2,373,778 | 4/1945 | Quiby | 40/605 |
| 2,749,636 | 6/1956 | Viglieta | 40/152 |
| 4,103,465 | 8/1978 | McDonald | 52/239 |
| 4,263,738 | 4/1981 | Donatelle | 40/606 |

FOREIGN PATENT DOCUMENTS

| | | | |
|---|---|---|---|
| 2716399 | 4/1977 | Fed. Rep. of Germany | 40/607 |

*Primary Examiner*—Gene Mancene
*Assistant Examiner*—Wenceslao J. Contreras
*Attorney, Agent, or Firm*—Rodgers & Rodgers

[57] ABSTRACT

Means for attaching a panel to an upright comprising a pair of uprights, multiple apertures formed in the uprights, a panel disposed between or on each of the uprights, bracket assemblies joined respectively to the side edges of the panel, the bracket assemblies comprising a pair of bracket elements having notches formed respectively therein, and the notches of each assembly being disposed in the associated aperture and in an interlocking relationship with the associated upright.

9 Claims, 6 Drawing Figures

MEANS FOR ATTACHING A PANEL TO AN UPRIGHT

TECHNICAL FIELD

This invention relates to means for attaching a panel to an upright and more particularly to merchandising signs which are economical to fabricate, easy to assemble, and resistant to mechanical failure.

BACKGROUND ART

Signs used in the promotion and marketing of various goods and services are constructed in a wide variety of embodiments and are assembled by many different techniques. Of course it is desirable to produce a sign which is economical to manufacture and, at the same time, is convenient to assemble.

DISCLOSURE OF THE INVENTION

By this invention means for attaching a panel to an upright is provided and comprises an upright having an aperture formed therein, a panel disposed adjacent the upright, a bracket assembly joined to a side edge of the panel and having a pair of notches formed therein, and the notches being disposed in the aperture and being interlocked with the upright.

BEST MODE FOR CARRYING OUT THE INVENTION

Figure 1:
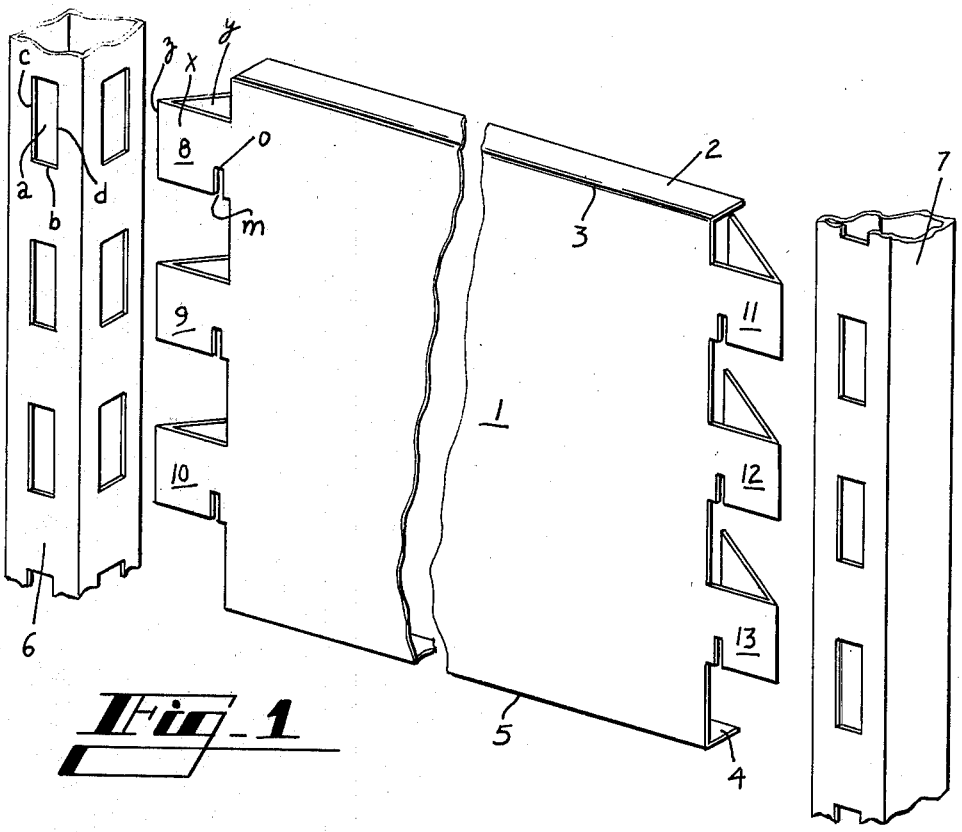
FIG. 1 is an exploded perspective view showing a merchandising sign formed according to this invention.

With reference to the drawing and with particular reference to FIG. 1, the numeral 1 designates the panel of the merchandising sign formed according to this invention. To the upper edge of panel 1, upper lip 2 is integrally joined along junction 3. In similar fashion, lower lip 4 is integrally joined to the lower edge of panel 1 along junction 5.

The uprights for the merchandising sign are of conventional construction and are identified in the drawing by the numerals 6 and 7. Uprights 6 and 7 are shown as having four sides although uprights of other types could be utilized in connection with this invention. Each of the uprights has multiple apertures identified by the letter a formed therein. Each aperture a has a lower edge b and side edges c and d.

According to one form of this invention, the merchandising sign is provided with bracket assemblies. More specifically and as best shown in FIG. 1, bracket assemblies 8, 9 and 10 are integrally joined to one side edge of panel 1. In similar fashion, bracket assemblies 11, 12 and 13 are integrally joined along the opposite side edge of panel 1. Since each of the bracket assemblies 8–13 is of virtually identical construction, only one will be discussed in detail.

Figure 2:
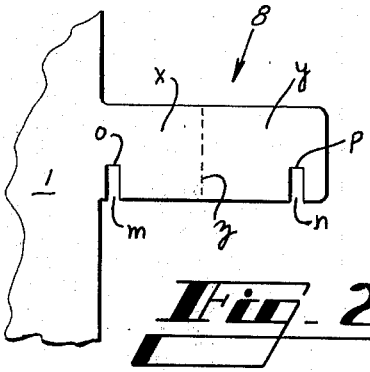
FIG. 2 is a fragmentary plan view showing the bracket assembly as it appears during an intermediate stage of manufacture.
Figure 3:
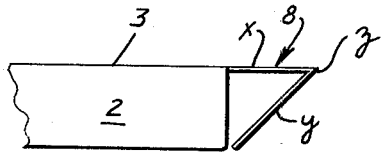
FIG. 3 is a fragmentary view showing a completed bracket assembly from above prior to insertion into an upright.

With particular reference to bracket assembly 8, this assembly comprises bracket element x and bracket element y which are integrally joined along weakened bend line z. As best viewed in FIG. 2, bracket elements x and y are provided respectively with notches m and n which are formed along the lower portions thereof. The upper edges of notches m and n are identified respectively to the letters o and p. In addition bracket element y is dimensionally wider than bracket element x.

Figure 4:
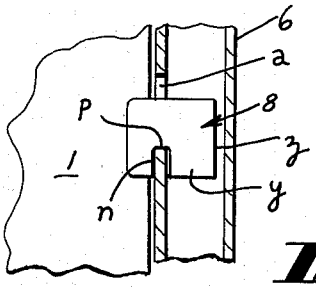
FIG. 4 is a cross sectional side view and depicts the bracket assembly in an interlocked relationship with one of the uprights.
Figure 5:
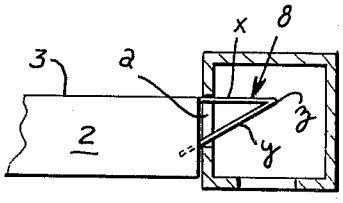
FIG. 5 is a cross sectional plan view similar to FIG. 3 showing the bracket assembly in its interlocked condition.

In order to form the merchandising sign according to this invention, initially it is necessary to place uprighs 6 and 7 in vertical positions. Then bracket element y of each bracket assembly 8–13, which has been folded along bend line z during manufacture to an angle of approximately 45° with bracket element x, is further folded along bend line z whereby the bracket assembly can be inserted into the corresponding aperture a to a position where notches m and n are disposed directly above the associated lower edge b. Following this the entire panel 1 is simply lowered until upper edges of o and p of notches m and n come into contact with the respective lower edge b of each aperture a. Generally simultaneously with this operation, bracket elements x and y of each bracket assembly are allowed to spread apart to an angle of approximately 15° due to the natural tendency to move in this fashion which is inherent in the material from which the sign is constructed. Since bracket element y is wider than bracket element x, the free end of bracket element y extends inwardly of the sign beyond the junction between bracket element x and panel 1. Thus added reinforcing material is provided between notch n and the free end of bracket element y. Of course bracket elements x and y will move to positions whereby the outer surfaces thereof are in abutting relationship with side edges c and d. The bracket assemblies then appear as depicted in FIGS. 4 and 5.

Figure 6:
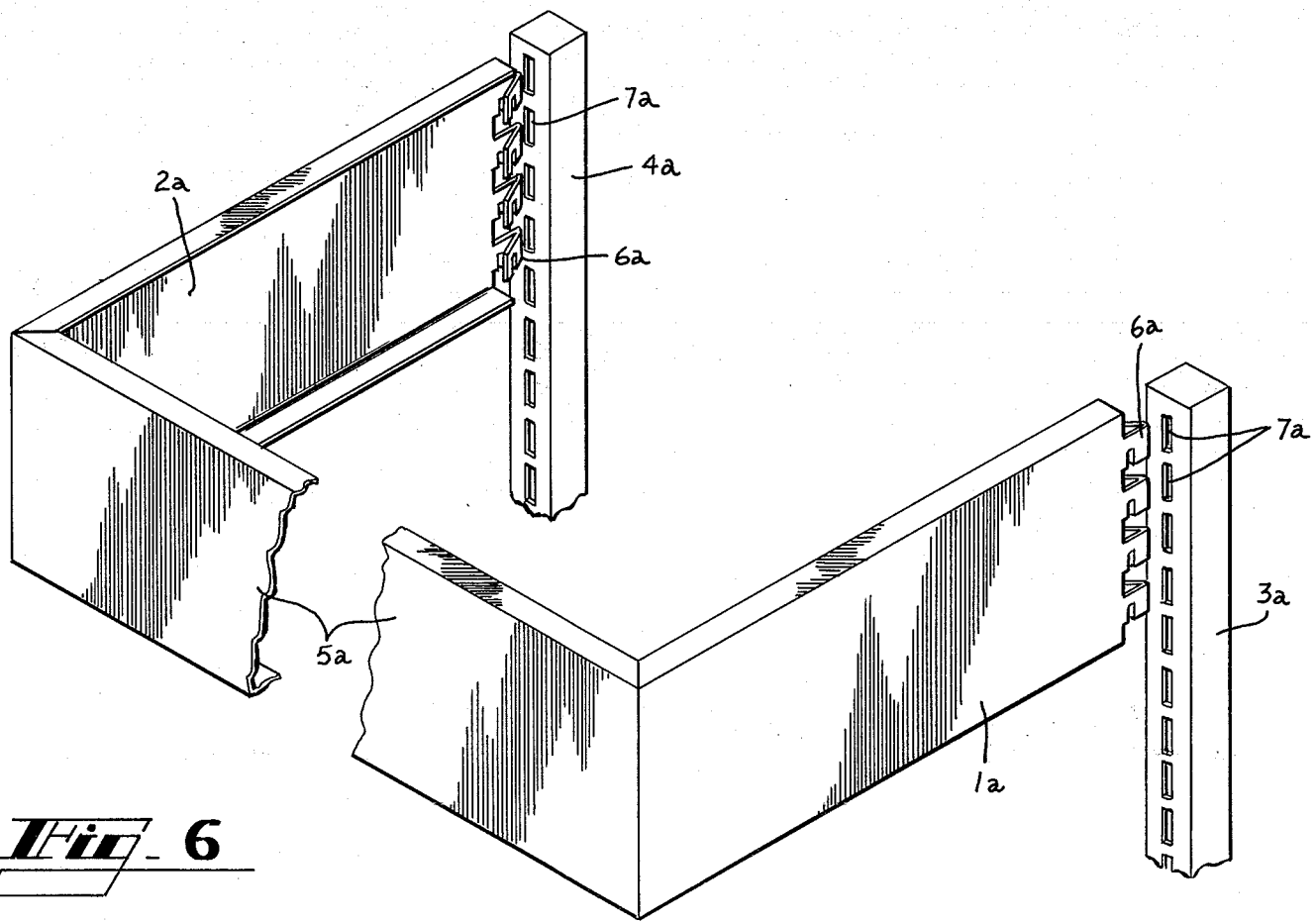
FIG. 6 is a perspective view showing an alternative form of the invention in a partially completed condition.

FIG. 6 depicts an alternative form of the invention whereby side panels 1*a* and 2*a* of the merchandising sign are adapted for being mounted respectively on uprights 3*a* and 4*a*. To the free ends of side panels 1*a* and 2*a*, front panel 5*a* is secured respectively along the ends thereof. The bracket assemblies 6*a* of side panels 1*a* and 2*a* cooperate with corresponding apertures 7*a* in the same manner as discussed above in connection with the form of the invention shown in FIGS. 1–5.

Therefore it can be seen that each bracket assembly 8–13 and 6*a* is in effect wedged between the side edges c and d of the corresponding aperture and any tendency for the merchandising sign to twist or inadvertently fall apart is virtually eliminated.

INDUSTRIAL APPLICABILITY

By this invention a merchandising sign is provided which is economical to manufacture, easy to assemble and which is extremely sturdy.

We claim:

1. Means for attaching a panel to an upright comprising an upright, at least one aperture formed in said upright, a panel disposed adjacent said upright, a first bracket element joined to one side edge of said panel, a second bracket element joined to said first bracket element remote from said panel and disposed at an acute angle to said first bracket element, a pair of notches formed respectively in said bracket elements, and said notches being disposed in said aperture and in an interlocking relationship with said upright.

2. Means according to claim 1 wherein said notches have upper edges and wherein said aperture has a lower edge and wherein said upper edges are disposed in an abutting relationship with said lower edge.

3. Means according to claim 2 wherein said aperture has a pair of side edges extending upwardly respectively from the ends of said lower edge and wherein the outer surfaces of said bracket elements are disposed respectively in abutting relationship with said side edges.

4. Means according to claim 3 wherein said acute angle is approximately 15°.

5. Means according to claim 1 wherein an upper lip is secured along the upper edge of said panel.

6. Means according to claim 1 wherein a lower lip is secured along the lower edge of said panel.

7. Means according to claim 1 wherein said second bracket element is wider than said first bracket element.

8. A method of attaching a panel to an upright comprising the steps of folding a pair of interconnected bracket elements one of which is joined to the side edge of a panel through an obtuse angle, inserting said bracket elements into an aperture formed in an upright, and allowing said bracket elements to expand through an acute angle.

9. A method according to claim 8 wherein said bracket elements have a pair of notches formed respectively therein and wherein the upper edges of said notches are placed on the lower edge of said aperture.

* * * * *